US010597812B2

(12) United States Patent
Hirota et al.

(10) Patent No.: US 10,597,812 B2
(45) Date of Patent: Mar. 24, 2020

(54) DRUM WASHING MACHINE

(71) Applicants: AQUA CO., LTD., Tokyo (JP); Qingdao Haier Washing Machine Co., Ltd., Shandong (CN)

(72) Inventors: Hiromi Hirota, Tokyo (JP); Shigeharu Nakamoto, Tokyo (JP)

(73) Assignees: Aqua Co., Ltd. (JP); Qingdao Haier Washing Machine Co., Ltd. (CN)

( * ) Notice: Subject to any disclaimer, the term of this patent is extended or adjusted under 35 U.S.C. 154(b) by 209 days.

(21) Appl. No.: 15/739,176

(22) PCT Filed: Jun. 29, 2016

(86) PCT No.: PCT/CN2016/087625

§ 371 (c)(1),
(2) Date: Dec. 22, 2017

(87) PCT Pub. No.: WO2017/000881

PCT Pub. Date: Jan. 5, 2017

(65) Prior Publication Data

US 2018/0187359 A1 Jul. 5, 2018

(30) Foreign Application Priority Data

Jun. 29, 2015 (JP) ..... 2015-130473

(51) Int. Cl.
*D06F 37/40* (2006.01)
*D06F 23/02* (2006.01)
*D06F 23/06* (2006.01)

(52) U.S. Cl.
CPC ..... *D06F 37/40* (2013.01); *D06F 23/02* (2013.01); *D06F 23/06* (2013.01)

(58) Field of Classification Search
CPC ..... D06F 37/40; D06F 23/06; D06F 23/02
See application file for complete search history.

(56) References Cited

U.S. PATENT DOCUMENTS 2,942,447 A * 6/1960 Rickel ..... D06F 25/00 68/23.1
3,033,014 A * 5/1962 Neyhouse ..... D06F 37/40 68/19.2

(Continued)

FOREIGN PATENT DOCUMENTS

CN 1746378 A 3/2006
CN 1888197 A 1/2007

(Continued)

OTHER PUBLICATIONS

European Search Report from related EP Application No. 16817245.0 dated Nov. 15, 2018.

*Primary Examiner* — Benjamin L Osterhout
(74) *Attorney, Agent, or Firm* — Burns & Levinson, LLP; Joseph M. Maraia

(57) ABSTRACT

A drum washing machine includes a driving part which includes a driving motor, a first belt wheel fixed to a rotating shaft of a drum, a second belt wheel fixed to a rotating shaft of a rotating body, a first motor belt wheel fixed to a motor shaft of the driving motor and connected to the first belt wheel via a first transmission belt, a second motor belt wheel connected to the second belt wheel via a second transmission belt, and a clutch mechanism part configured for switching from a first driving form in which the second motor belt wheel is engaged with the clutch mechanism part so that the drum and the rotating body rotate at different speeds driven by the driving motor, and a second driving form in which the motor shaft is disconnected from the second motor belt wheel.

12 Claims, 10 Drawing Sheets

(56) References Cited

U.S. PATENT DOCUMENTS

| | | | | | |
|---|---|---|---|---|---|
| 3,091,974 | A | * | 6/1963 | Brill | D06F 37/206 474/86 |
| 3,153,951 | A | | 10/1964 | Whelan | |
| 3,252,357 | A | * | 5/1966 | Smith | D06F 33/00 74/810.1 |
| 3,301,024 | A | * | 1/1967 | Smith | D06F 33/02 68/12.15 |
| 3,324,689 | A | * | 6/1967 | Bergman | D06F 37/30 68/12.02 |
| 3,339,423 | A | * | 9/1967 | Bergeson | D06F 37/30 474/70 |
| 3,584,482 | A | * | 6/1971 | Brucken | D06F 37/36 68/23 R |
| 3,744,325 | A | * | 7/1973 | Brucken | D06F 37/36 74/82 |
| 6,012,306 | A | * | 1/2000 | Raes | D06F 25/00 68/122 |

FOREIGN PATENT DOCUMENTS

| | | | |
|---|---|---|---|
| CN | 203890713 | U | 10/2014 |
| CN | 203890716 | U | 10/2014 |
| GB | 972411 | A | 10/1964 |
| JP | S5560884 | U | 4/1980 |
| JP | H03280992 | A | 12/1991 |
| JP | 2006158488 | A | 6/2006 |
| KR | 1019940018515 | | 8/1994 |
| KR | 950007852 | B1 | 7/1995 |

* cited by examiner

DRUM WASHING MACHINE

CROSS REFERENCE TO RELATED APPLICATIONS

This application is the U.S. national phase entry under 35 U.S.C. § 371 of International Application No. PCT/CN2016/087625, filed Jun. 29, 2016, entitled DRUM WASHING MACHINE, which claims priority to Japanese Patent Application No. 2015-130473, filed Jun. 29, 2015, the contents of which are incorporated herein by reference in their entirety for all purposes.

TECHNICAL FIELD

The present disclosure relates to a drum washing machine, which not only can be continuously operated from washing to drying, but also can carry out washing without drying.

BACKGROUND

Conventionally, a drum washing machine rotates a transverse-shaft type drum in an outer tub storing water at its bottom, washings are lifted up and dropped down by baffles arranged in the drum, and are thrown to an inner circumferential surface of the drum to realize washing.

For this structure of stirring the washings by the baffles, the washings are difficult to twine or rub against each other. Therefore, compared with a full automatic washing machine which washes the washings through rotation of a pulsator inside a washing and dewatering tank, a mechanical force acting on the washings is easy to become smaller and thus a cleaning performance is easy to lower.

Therefore, in the drum washing machine, the following structure can be adopted in order to improve the cleaning performance: a rotating body with a protruding part on a surface is arranged at an end part of the drum, and the drum and the rotating body can rotate at different rotation speeds during washing and rinsing.

A driving part that enables the drum and the rotating body to rotate can be, for example, configured in such a structure that the driving part is provided with a driving motor used for the drum and a driving motor used for the rotating body; the rotation of the driving motor used for the drum is transmitted to a rotating shaft of the drum by transmission belts and belt wheels so as to rotate the drum; and the rotation of the driving motor used for the rotating body is transmitted to a rotating shaft of the rotating body by the transmission belts and the belt wheels so as to rotate the rotating body (with reference to a patent document 1).

CURRENT TECHNICAL DOCUMENT

Patent Document

Patent Document 1: Japanese Patent Publication No. 03-280992

Problems to be Solved by the Disclosure

Under a situation that the above structure is adopted in the driving part, since a simple speed reducing mechanisms composed of the transmission belts and the belt wheels is used for making the drum and the rotating body generate a rotating speed difference, the reliability is relatively high in term of fault and the like compared with a speed reducing mechanism composed of gears. However, since two driving motors are used for rotating the drum and the rotating body, it is difficult to manufacture the driving part at low cost.

SUMMARY

The present disclosure completes a technical solution in view of the above problems and aims at providing a drum washing machine which moves a drum and a rotating body by a driving part with low cost and high reliability.

Solution for Solving the Problems

The drum washing machine in a main mode of the present disclosure includes: an outer tub disposed in a housing; a drum disposed in the outer tub and being rotatable by using a horizontal axis or an inclination axis inclined relative to a horizontal direction as a center; a rotating body disposed in the drum and provided with a protruding part in contact with washings on a surface; and a driving part configured to rotate the drum and the rotating body. Herein, the driving part includes: a driving motor; a first belt wheel fixed to a rotating shaft of the drum; a second belt wheel fixed to a rotating shaft of the rotating body; a first motor belt wheel fixed to a motor shaft of the driving motor and connected with the first belt wheel via a first transmission belt; a second motor belt wheel connected with the second belt wheel via a second transmission belt; and a clutch mechanism part for switching a driving form of the driving part between a first driving form in which the drum and the rotating body rotate at different rotating speeds along with rotation of the driving motor through connection of the motor shaft and the second motor belt wheel in such a manner that the rotation of the motor shaft can be transmitted to the second motor belt wheel and the second driving form in which the motor shaft is disconnected from the second motor belt wheel in such a manner that the rotation of the motor shaft is not transmitted to the second motor belt wheel.

Through the above structure, since the drum and the rotating body generate a rotating speed difference by using a simple structure of speed reducing mechanisms composed of the transmission belts and the belt wheels, reliability of the driving part can be enhanced in term of fault and the like compared with a speed reducing mechanism composed of gears. Moreover, the drum and the rotating body can rotate by one driving motor, manufacturing the driving part at low cost.

In addition, through the above structure, during dewatering, when the driving form is switched to the second driving form, the rotating body is not rotated by the driving motor. Thus, washings attached to the inner circumferential surface of the drum are not actively stirred by the rotating body, thereby dewatering the washings well.

Further, through the above structure, since the clutch mechanism part adopts a structure which acts between the motor shaft of the driving motor and the second motor belt wheel, compared with a situation that the clutch mechanism part adopts a structure which acts between the second belt wheel larger than the second motor belt wheel and the rotating shaft of the rotating body, miniaturization of the structure of the clutch mechanism part can be realized and cost can be inhibited.

In the drum washing machine of the present embodiment, the clutch mechanism part can adopt the following structure: the clutch mechanism part includes a clutch part and a mobile mechanism part, wherein the clutch part can move to a first position where the motor shaft is connected with the second motor belt wheel in such a manner that the rotation of the motor shaft is transmitted to the second motor belt wheel and a second position where the motor shaft is disconnected from the second motor belt wheel in such a manner that the rotation of the motor shaft is not transmitted to the second motor belt wheel. The mobile mechanism part is configured to move the clutch part between the first position and the second position.

Through the above structure, a clutch mechanism part can be realized. Under a situation that the driving part is configured to be a structure of using a speed reducing mechanism composed of belts and belt wheels, the driving form of the driving part is well switched between the first driving form and the second driving form at a driving motor side through the clutch part and the mobile mechanism part that moving the clutch part. When the above structure is adopted, the clutch part can adopt such a structure capable of moving along an axial direction of the motor shaft relative to the motor shaft and capable of rotating together with the motor shaft and having an engaging part. In this case, the second motor belt wheel can adopt such a structure of having an engaged part engaged with the engaging part when the clutch part moves to the first position through the mobile mechanism part.

Through the above structure, in the first driving form, the clutch part is moved to the first position and the engaging part is engaged with the engaged part via the mobile mechanism part. Thus, the rotation of the motor shaft, i.e., the driving motor, is transmitted to the second motor belt wheel. On the other hand, in the second driving form, the clutch part is moved to the second position and the engaging part is disengaged from the engaged part via the mobile mechanism part. Thus, the rotation of the driving motor is not transmitted to the second motor belt wheel.

When the above structure is adopted, the clutch mechanism part can adopt such a structure including an encircling part that encircles the clutch part in such a manner that the clutch part freely rotates. In this case, the mobile mechanism part is connected with the encircling part.

When such a structure is adopted, since the non-rotatable encircling part is disposed and the mobile mechanism part is connected to the encircling part, the non-rotatable mobile mechanism part can be used to move the rotating clutch part along the axial direction.

Under a situation that the clutch mechanism part is composed of the clutch part and the mobile mechanism part, the driving motor can adopt a structure that the driving motor is fixed to the outer tub via a vibration-proof member. In this case, the mobile mechanism part is fixed to the driving motor.

Under a situation that the driving motor is fixed to the outer tub via the vibration-proof member, the vibration of the outer tub is difficult to be transmitted to the driving motor. On the other hand, a movement difference is generated between the outer tub and the driving motor. In the above structure, since the mobile mechanism part is fixed to the driving motor side, even if the movement difference is generated between the outer tub and the driving motor, it is difficult to apply a load to a connection part between the clutch part and the mobile mechanism part. Therefore, reliability of the clutch mechanism part can be enhanced.

In the drum washing machine of the present embodiment, the second motor belt wheel can adopt a structure that the second motor belt wheel is supported by the motor shaft in a free rotation manner.

Through the above structure, the motor shaft acts as a supporting shaft which supports the second motor belt wheel in a free rotation manner. Therefore, since it is unnecessary to additionally provide a supporting shaft, the cost can be reduced. Moreover, it is unnecessary to conduct shaft alignment between the supporting shaft and the motor shaft when the supporting shaft is provided, so that assembling operation of the driving part becomes easy.

Effects of the Disclosure

The present disclosure is to provide the drum washing machine which can enable the drum and the rotating body to rotate by the driving part with low cost and high reliability.

The effects and the significance of the present disclosure may be further defined through the description of embodiments shown below. However, embodiments below are merely examples when the present disclosure is implemented, and the present disclosure is not limited to the embodiments below.

A LIST OF REFERENCE NUMERALS

10: housing; 20: outer tub; 22: drum; 24: rotating body; 24*a*: protruding part; 30: driving part; 100: driving motor; 200: first rotating shaft; 300: second rotating shaft; 500: drum speed reducing mechanism part; 510: first belt wheel; 520: first motor belt wheel; 530: first transmission belt; 600: wing speed reducing mechanism part; 610: second belt wheel; 620: second motor belt wheel; 630: second transmission belt; 623: spline (engaged part); 700: clutch mechanism part; 710: clutch body; 711: clutch part; 712: encircling part; 715: first spline (engaging part); 720: clutch lever; 730: lever supporting part; 740: lever driving apparatus; 750: installing plate; and M1: mobile mechanism part.

DETAILED DESCRIPTION

An embodiment of a drum washing machine of the present disclosure, i.e., a drum washing machine without a drying function, is described below with reference to drawings.

Figure 1:
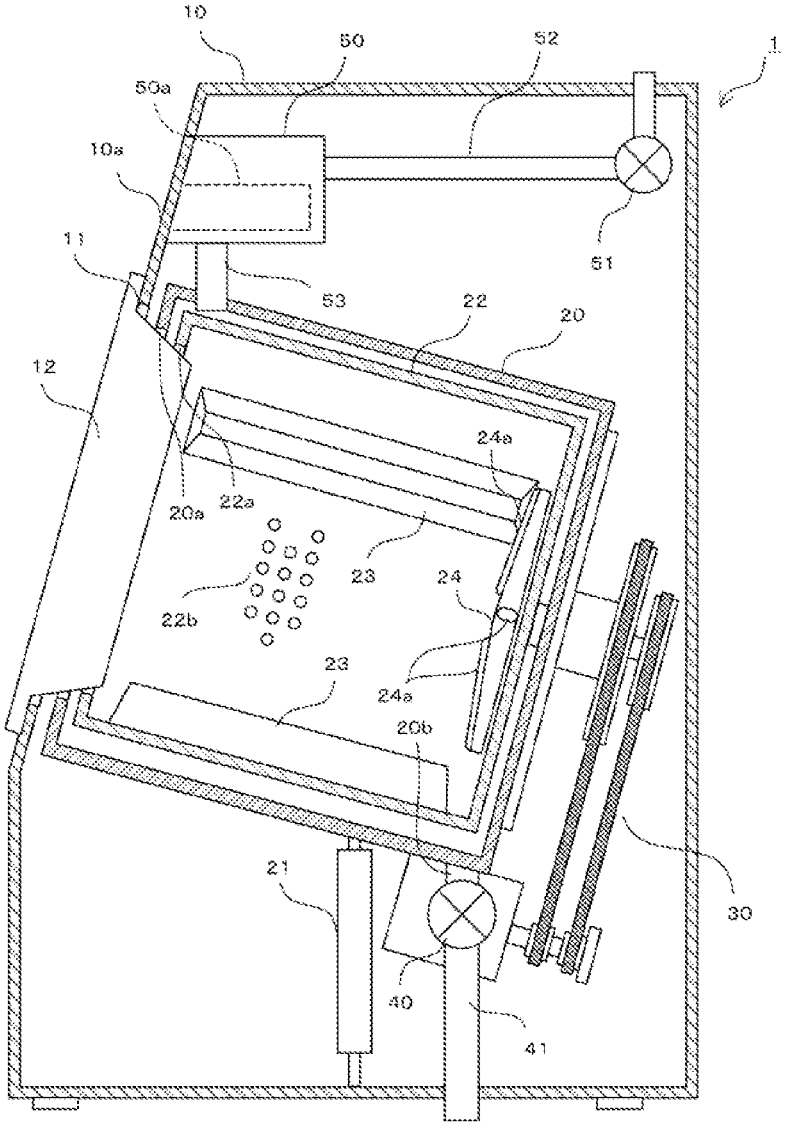
FIG. 1 is a side sectional view illustrating a structure of a drum washing machine according to embodiments.

FIG. 1 is a side sectional view illustrating a structure of a drum washing machine 1.

The drum washing machine 1 is provided with a housing 10 forming an appearance. A front surface 10*a* of the housing 10 is inclined from a central part to an upper part. A throwing inlet 11 for washings is formed in the inclined surface and is covered by a freely opened/closed door 12.

An outer tub 20 is elastically supported by a plurality of shock absorbers 21 in the housing 10. A drum 22 is disposed in the outer tub 20 in a free rotation manner. The outer tub 20 and the drum 22 are inclined in such a manner that rear surface sides become lower relative to a horizontal direction. Therefore, the drum 22 rotates by using an inclination axis inclined relative to the horizontal direction as a center. The inclination angles of the outer tub 20 and the drum 22 can be set as about 10-20 degrees. An opening part 20*a* of the front surface of the outer tub 20 and an opening part 22*a* of the front surface of the drum 22 are opposite to the throwing inlet 11 and are closed together with the throwing inlet 11 by the door 12. A plurality of dewatering holes 22*b* are formed in a circumferential surface of the drum 22. Then, three baffles 23 are arranged on the inner circumferential surface of the drum 22 along the circumferential direction at substantially equal intervals.

A rotating body 24 is disposed at a rear part of the drum 22 in a free rotation manner and has approximate substantially disc shape. A plurality of protruding parts 24*a* radially extending from the central part are formed on the surface of the rotating body 24. The rotating body 24 and the drum 22 coaxially rotate.

A driving part 30 generating a torque for driving the drum 22 and the rotating body 24 is disposed behind the outer tub 20. The driving part 30 enables the drum 22 and the rotating body 24 to rotate along the same direction at different rotating speeds in a washing process and a rinsing process. Specifically, the driving part 30 enables the drum 22 to rotate at a rotating speed that the centrifugal force exerted to the washings in the drum 22 is less than the gravity of the washings and enables the rotating body 24 to rotate at a rotating speed higher than the rotating speed of the drum 22.

In another aspect, the driving part 30 enables the drum 22 to rotate at a rotating speed that the centrifugal force exerted to the washings in the drum 22 is far more than the gravity of the washings in a dewatering process. In another aspect, the rotating body 24 does not rotate by the generated torque. The rotating body 24 is in a state of free rotation in the drum 22. A detailed structure of the driving part 30 is described subsequently.

A drainage outlet part 20*b* is formed in the bottom of the outer tub 20. A drainage valve 40 is arranged in the drainage outlet part 20*b* and is connected with a drainage hose 41. Water stored in the outer tub 20 is discharged out of the machine through the drainage hose 41 when the drainage valve 40 is opened.

A detergent box 50 is disposed at a front upper part in the housing 10. A detergent container 50*a* containing a detergent, which can be freely drawn out from the front of the detergent box 50, is contained in the detergent box 50. The detergent box 50 is connected with a water feed valve 51 disposed at a rear upper part in the housing 10 through a water supply hose 52. In addition, the detergent box 50 is connected with the upper part of the outer tub 20 through a water injection pipe 53. Tap water from a faucet is supplied into the outer tub 20 through the water supply hose 52, the detergent box 50 and the water injection pipe 53 when the water supply valve 51 is opened. At this moment, the detergent contained in the detergent container 50*a* is supplied into the outer tub 20 along with a water flow.

Next, a structure of the driving part 30 is described in detail.

Figure 2:
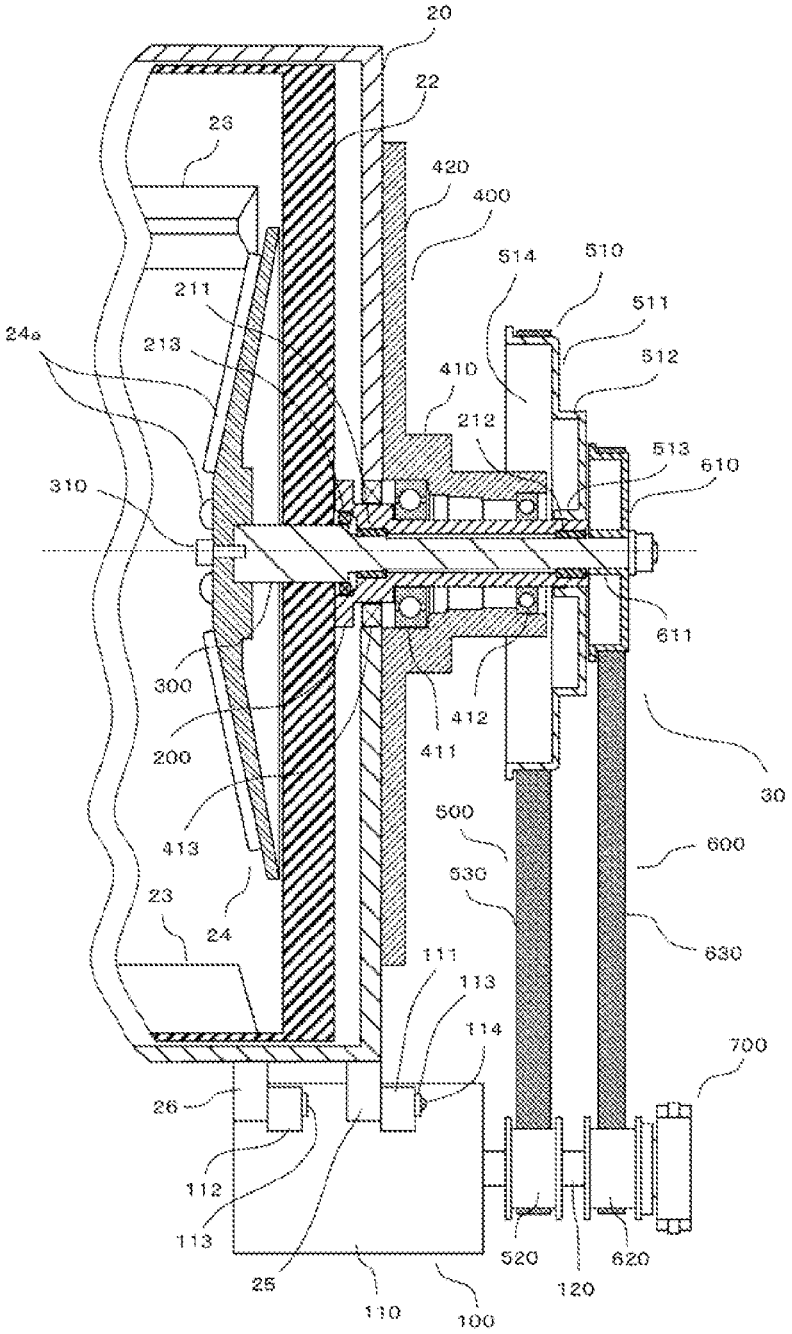
FIG. 2 is a diagram illustrating a structure of a driving part according to embodiments.
Figure 3:
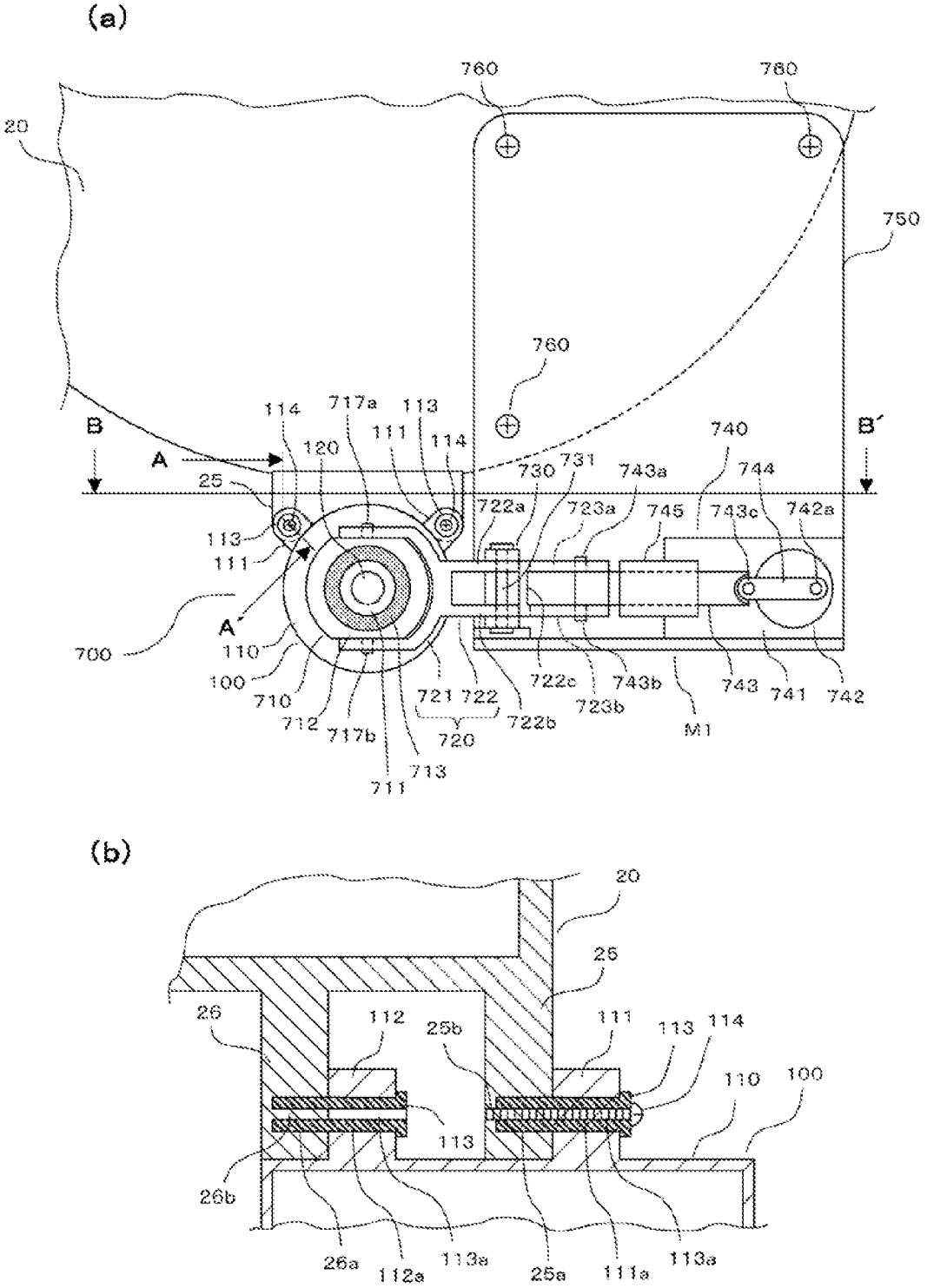
FIG. 3 is a diagram illustrating a structure of a driving part according to embodiments.
Figure 4:
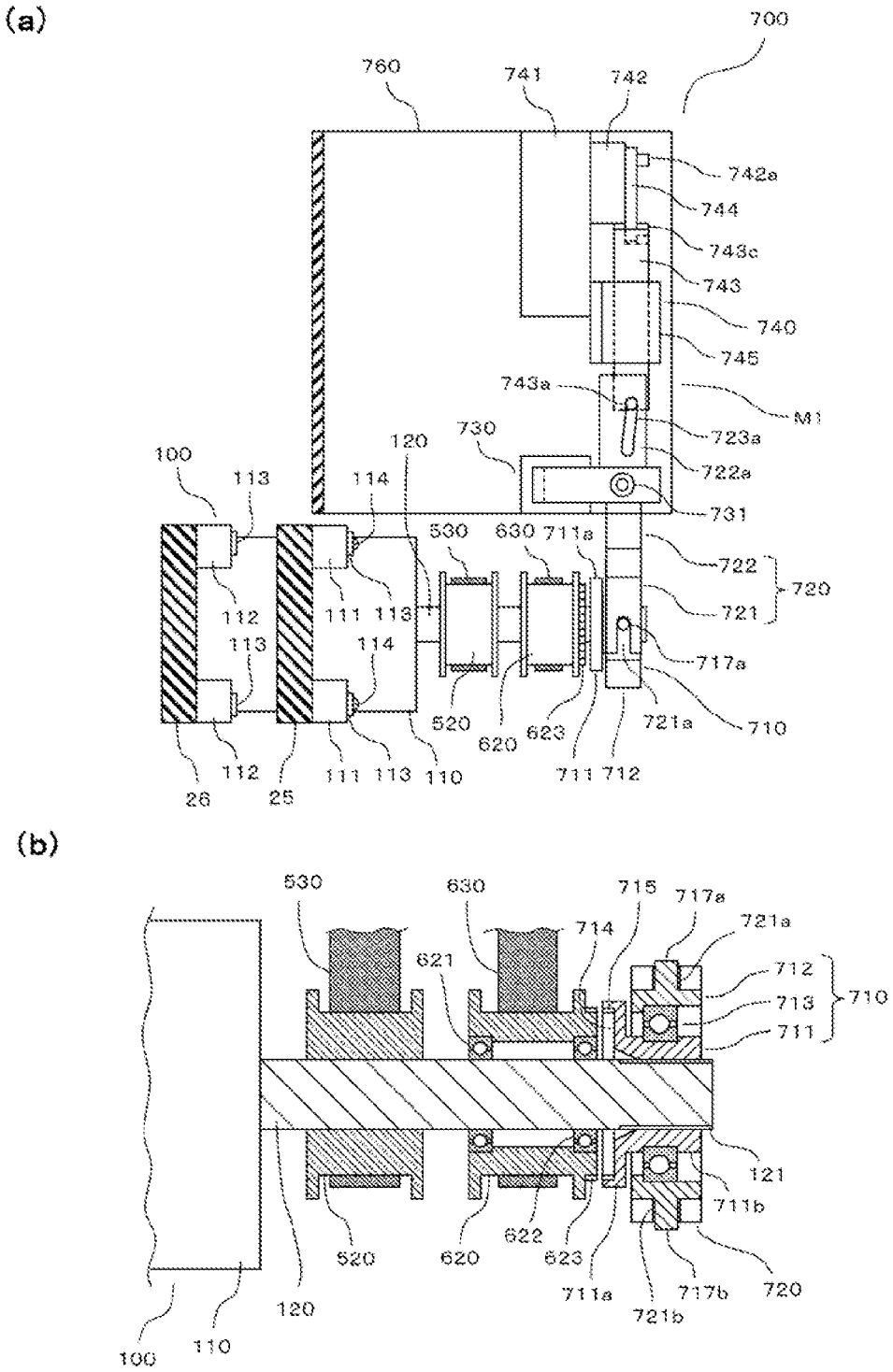
FIG. 4 is a diagram illustrating a structure of a driving part according to embodiments.
Figure 5:
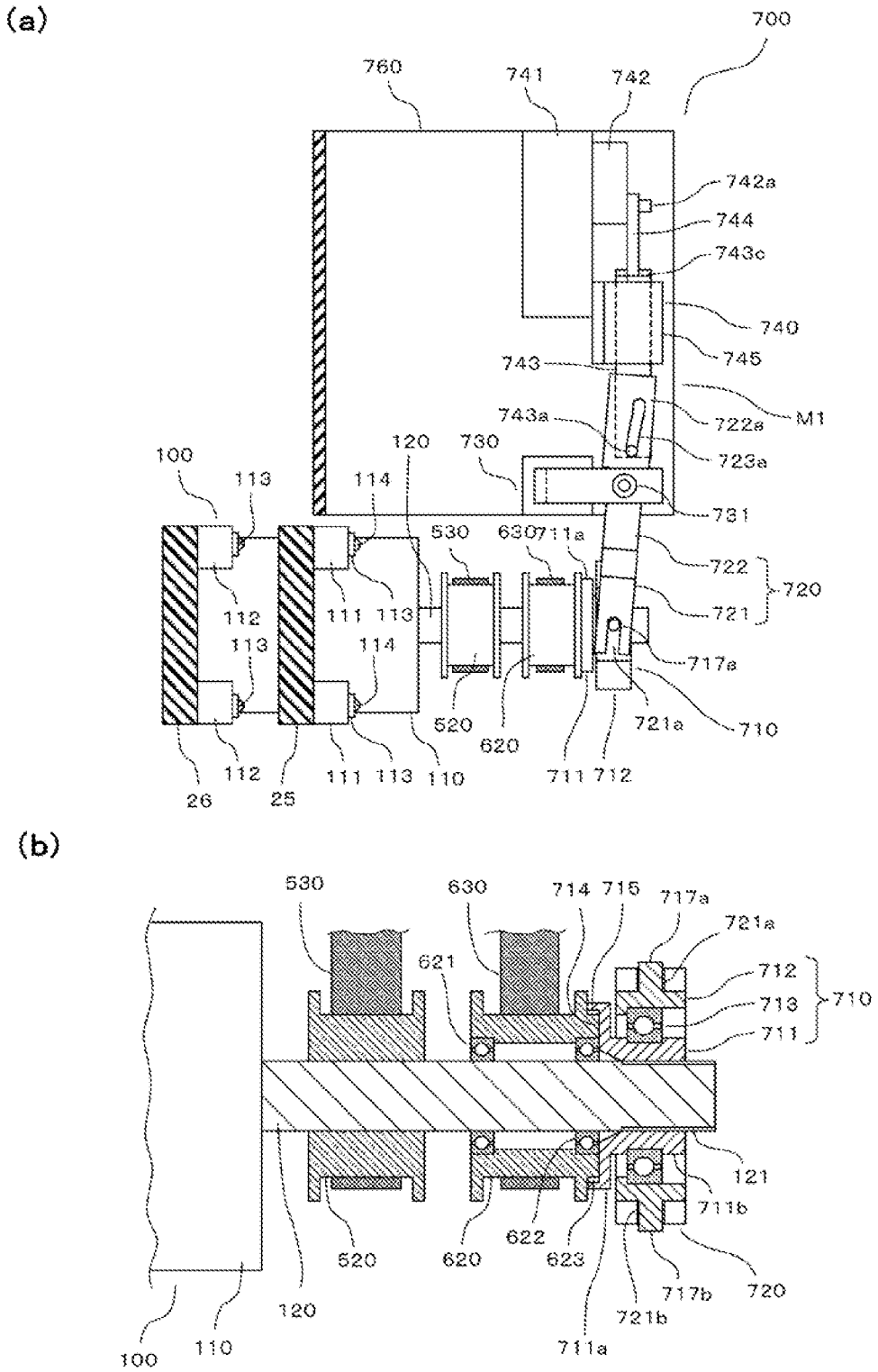
FIG. 5 is a diagram illustrating a structure of a driving part according to embodiments.
Figure 6:
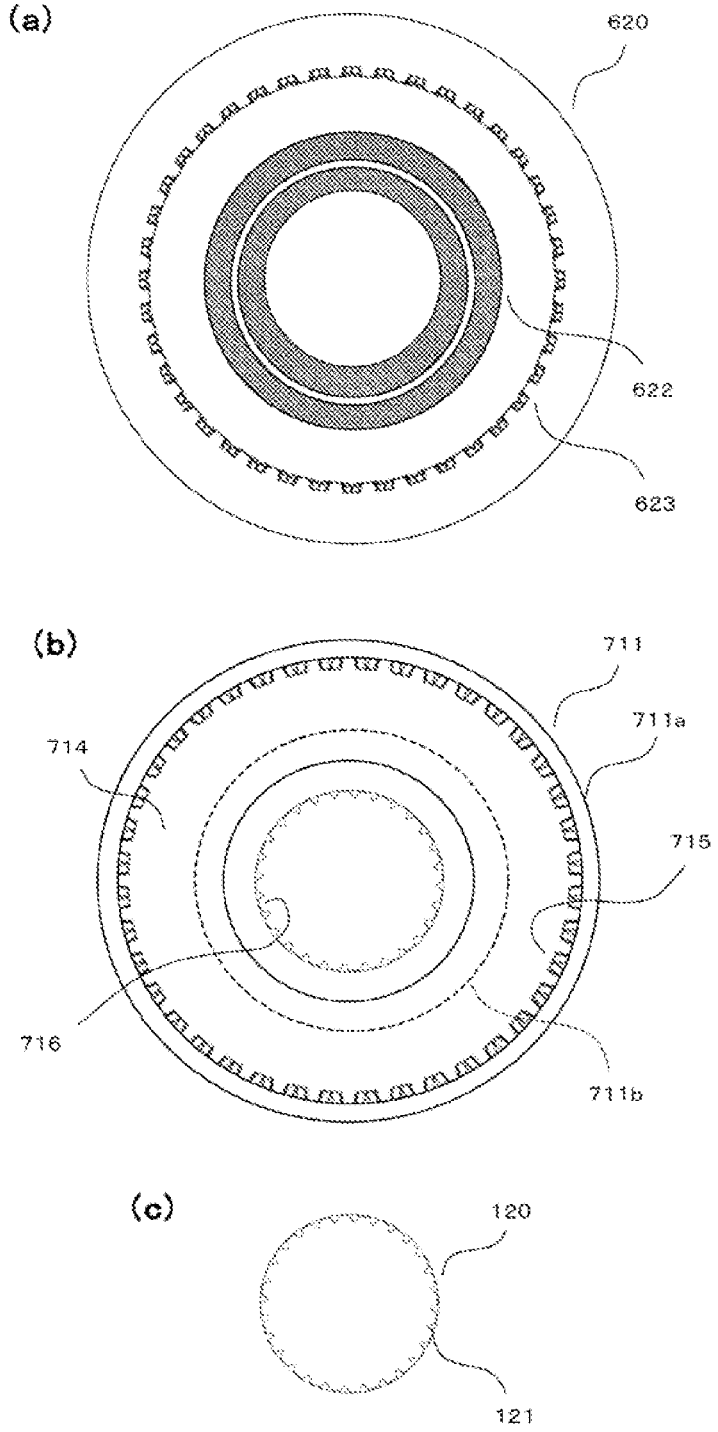
FIG. 6 is a diagram illustrating a structure of a driving part according to embodiments.

FIGS. 2 to 6 are diagrams illustrating the structure of the driving part 30. FIG. 2 is a longitudinal sectional view illustrating the structure of the driving part 30. FIG. 3(*a*) is a diagram illustrating a lower part of the outer tub 20 observed from a rear side. FIG. 3(*b*) is a sectional view taken along a line A-A' of FIG. 3(*a*). FIG. 4(*a*) and FIG. 5(*a*) are sectional views taken along a line B-B' of FIG. 3(*a*). FIG. 4(*b*) and FIG. 5(*b*) are longitudinal sectional views illustrating a peripheral part of a motor shaft 120. FIGS. 4(*a*) and (*b*) indicate a state that a driving form of the driving part 30 is switched to a drum single driving form. FIGS. 5(*a*) and (*b*) indicate a state that the driving form of the driving part 30 is switched to a biaxial driving form. FIG. 6(*a*) is a rear view of a second motor belt wheel 620. FIG. 6(*b*) is a front view of a clutch part 711. FIG. 6(*c*) is a front view of a front end part of the motor shaft 120. It shall be noted that a first transmission belt 530 and a second transmission belt 630 are not shown in FIG. 3(*a*).

The driving part 30 includes: a driving motor 100, a first rotating shaft 200, a second rotating shaft 300, a bearing unit 400, a drum speed reducing mechanism part 500, a wing speed reducing mechanism part 600 and a clutch mechanism part 700.

The driving motor 100 generates the torque used for driving the drum 22 and the rotating body 24. The driving motor 100 is, for example, an outer rotor type direct current (DC) brushless motor, and the motor shaft 120 connected with a rotor in a shell 110 of the driving motor 100 extends backwards from the shell 110.

At the upper part of the shell 110, front installing bulges 111 are formed on left and right sides at the front of the shell, and rear installing bulges 112 are formed on left and right sides at the rear of the shell. On the other hand, front fixing parts 25 corresponding to the front installing bulges 111 and rear fixing parts 26 corresponding to the rear installing bulges 112 are formed at the bottom of the outer tub 20. As shown in FIG. 3(*b*), inserting through holes 111*a* and 112*a* are formed in the front installing bulges 111 and the rear installing bulges 112, respectively, for the passageway of the vibration-proof member 113 and an installing screw 114 therethrough. An installing hole 25*a* for insertion of the vibration-proof member 113 and the installing screw 114 therethrough and a screw hole 25*b* for fixing the installing screw 114 are formed in the front fixing parts 25. Inserting holes 26*a* are formed in the rear fixing parts 26 for insertion of the vibration-proof member 113 therethrough. A shaft 26*b* is formed at a bottom surface of the inserting hole 26*a*. The vibration-proof member 113 is made of elastic material such as rubber. A through hole 113*a* is formed in the center of the vibration-proof member 113.

After the vibration-proof member 113 is inserted into the inserting through hole 111*a* of the front installing bulges 111 and the installing hole 25*a* of the front fixing parts 25, the installing screw 114 is fixed to the screw hole 25*b* of the front fixing parts 25 through the through hole 113*a* of the vibration-proof member 113. In addition, the vibration-proof member 113 is inserted into the inserting through hole 112*a* of the rear installing bulges 112 and the inserting hole 26*a* of the rear fixing parts 26. At this moment, the through hole 113*a* of the vibration-proof member 113 is inserted into the shaft 26*b* of the rear fixing parts 26. In this way, the driving motor 100 is fixed to the outer tub 20 via the vibration-proof member 113.

It should be noted that although the front installing bulges 111 and the front fixing parts 25 are only fixed by the installing screw 114 in the present embodiment, the rear fixing parts 26 can also be configured into a structure the same as the front fixing parts 25 and the rear installing bulges 112 and the rear fixing parts 26 are fixed by the installing screw 114.

The first rotating shaft 200 is in a hollow shape. A first sliding bearing 211 and a second sliding bearing 212 are respectively arranged on a front part and a rear part in an inner part of the first rotating shaft 200, and a mechanical shaft seal 213 is arranged on a front end part of the first rotating shaft 200.

The second rotating shaft 300 passes through the first rotating shaft 200. The front part of the second rotating shaft 300 protrudes forwards from the first rotating shaft 200, and the rear part of the second rotating shaft 300 protrudes backwards from the first rotating shaft 200. An outer circumferential surface of the second rotating shaft 300 is supported by the first sliding bearing 211 and the second sliding bearing 212, and the second rotating shaft 300 smoothly rotates in the first rotating shaft 200. In addition, the mechanical shaft seal 213 can prevent water from entering a space between the second rotating shaft 300 and the first rotating shaft 200.

A substantially cylindrical bearing part 410 is arranged at the central part of the bearing unit 400. A first rolling bearing 411 and a second rolling bearing 412 are respectively arranged at the front part and the rear part in the bearing part 410, and a mechanical shaft seal 413 is arranged at the front end part of the bearing part 410. An outer circumferential surface of the first rotating shaft 200 is supported by the first rolling bearing 411 and the second rolling bearing 412, and the first rotating shaft 200 smoothly rotates in the bearing part 410. In addition, the mechanical shaft seal 413 can prevent water from entering the space between the first rotating shaft 200 and the bearing part 410. Further, a fixed flange part 420 is formed at a periphery of the bearing part 410 of the bearing unit 400.

The bearing unit 400 is fixed to the rear surface of the outer tub 20 by fixing the flange part 420 through a fixing method such as screw fastening. Under the state that the bearing unit 400 is installed in the outer tub 20, the second rotating shaft 300 and the first rotating shaft 200 enter the inner part of the outer tub 20. The drum 22 is fixed to the first rotating shaft 200 by a screw not shown in the diagram, and the rotating body 24 is fixed to the second rotating shaft 300 by a screw 310.

The drum speed reducing mechanism part 500 includes: a first belt wheel 510, a first motor belt wheel 520 and a first transmission belt 530. The rotation of the driving motor 100 is decelerated according to a speed reducing ratio determined by an outer diameter ratio of the first belt wheel 510 to the first motor belt wheel 520 and is then transmitted to the first rotating shaft 200.

The first belt wheel 510 is formed in a dish shape with a front opening, and includes: a belt wheel part 511 and a fixing part 512 with an outer diameter less than that of the belt wheel part 511. A fixing bulge 513 is formed in the central part of the fixing part 512. The fixing bulge 513 is fixed to the first rotating shaft 200, so that the first belt wheel 510 is fixed to the rear end part of the first rotating shaft 200.

The rear end part of the bearing part 410 is contained in a concave part 514 recessed backwards, i.e., an inner part of the belt wheel part 511. Therefore, since the bearing unit 400 is overlapped with the first belt wheel 510 along the front-back direction of the driving part 30, the size of the driving part 30 along the front-back direction is reduced by a size corresponding to the overlapping part.

The first motor belt wheel 520 is installed at a base part of the motor shaft 120 of the driving motor 100. The first transmission belt 530 is suspended between the first belt wheel 510 and the first motor belt wheel 520.

The wing speed reducing mechanism part 600 includes: a second belt wheel 610, a second motor belt wheel 620 and a second transmission belt 630. The rotation of the driving motor 100 is decelerated according to a speed reducing ratio determined by an outer diameter ratio of the second belt wheel 610 to the second motor belt wheel 620 and is then transmitted to the second rotating shaft 300. Since the outer diameter of the first motor belt wheel 520 is equal to the outer diameter of the second motor belt wheel 620 and the outer diameter of the second belt wheel 610 is less than the outer diameter of the belt wheel part 511 of the first belt wheel 510, the speed reducing ratio of the wing speed reducing mechanism part 600 is less than the speed reducing ratio of the drum speed reducing mechanism part 500.

A fixing bulge 611 is formed in the central part of the second belt wheel 610. The fixing bulge 611 is fixed to the second rotating shaft 300, so that the second belt wheel 610 is fixed to the rear end part of the second rotating shaft 300.

The second motor belt wheel 620 is supported by the motor shaft 120 of the driving motor 100 in a free rotation manner. Namely, as shown in FIGS. 4(*b*) and 5(*b*), the second motor belt wheel 620 is installed at the substantially middle part of the motor shaft 120 through a front rolling bearing 621 and a rear rolling bearing 622. The second motor belt wheel 620 smoothly rotates relative to the motor shaft 120 by the rolling bearings 621 and 622.

As shown in FIG. 6(*a*), a spline 623 is formed on the second motor belt wheel 620 around an entire outer circumferential surface of the rear end part. The spline 623 is equivalent to the engaged part of the present disclosure.

The clutch mechanism part 700 switches the driving form of the driving part 30 between the biaxial driving form and the drum single driving form. The biaxial driving form is a driving form that enables the drum 22 and the rotating body 24 to rotate at different rotating speeds along with rotation of the driving motor 100 through connection of the second motor belt wheel 620 and the motor shaft 120 in such a manner that the rotation of the motor shaft 120 can be transmitted to the second motor belt wheel 620. The drum single driving form is a driving form that enables the drum 22 to rotate along with the rotation of the driving motor 100 and enables the rotating body 24 to be in a free rotation state through disconnection of the second motor belt wheel 620 from the motor shaft 120 in such a manner that the rotation of the motor shaft 120 is not transmitted to the second motor belt wheel 620. The biaxial driving form is equivalent to a first driving form of the present disclosure, and the drum single driving form is equivalent to a second driving form of the present disclosure.

The clutch mechanism part 700 includes: a clutch body 710, a clutch lever 720, a lever supporting part 730, a lever driving apparatus 740 and an installing plate 750.

The clutch body 710 is disposed on the front end part of the motor shaft 120 in a manner of being located at a rear side of the second motor belt wheel 620. As shown in FIGS. 4(*b*) and 5(*b*), the clutch body 710 includes a clutch part 711, an encircling part 712 and a rolling bearing 713. The clutch part 711 is formed in a substantially cylindrical shape, and the outer diameter of its front end part 711*a* is larger than the outer diameter of a body part 711*b* at the rear side of the front end part 711*a*. An engaging recess 714 having an inner diameter approximately equal to the outer diameter of the rear end part of the second motor belt wheel 620 is formed at the front end part 711*a*. As shown in FIG. 6(*b*), a first spline 715 is formed around an entire inner circumferential surface of the engaging recess 714. In addition, a second spline 716 is formed around an entire inner circumferential surface of the body part 711*b*. The first spline 715 is equivalent to the engaging part of the present disclosure.

As shown in FIG. 6(*c*), a spline 121 is formed around the entire outer circumferential surface at the front end part of the motor shaft 120. A front-back size of the spline 121 is set to be greater than a front-back size of the second spline 716.

The second spline 716 of the clutch part 711 is engaged with the spline 121 of the motor shaft 120. Through the engagement, the clutch part 711 is capable of moving along an axial direction of the motor shaft 120 relative to the motor shaft 120 and rotating together with the motor shaft 120.

The encircling part 712 is configured to be a ring shape and encircle the central part of the clutch part 711 in such a manner that the clutch part 711 freely rotates. A rolling bearing 713 is sandwiched between the clutch part 711 and the encircling part 712. The clutch part 711 smoothly rotates relative to the encircling part 712 by the rolling bearing 713.

An upper part of the encircling part 712 is configured to be a flat surface, on which an upper shaft part 717*a* is formed. A lower part of the encircling part 712 is also configured to be a flat surface, on which a lower shaft part 717*b* is formed.

The clutch lever 720, the lever supporting part 730, the lever driving apparatus 740 and the installing plate 750 form the mobile mechanism part M1. As mentioned below, the mobile mechanism part M1 enables the clutch body 710 to move to a first position where the motor shaft 120 is connected with the second motor belt wheel 620 in such a manner that the rotation of the motor shaft 120 is transmitted to the second motor belt wheel 620; and a second position where the motor shaft 120 is disconnected from the second motor belt wheel 620 in such a manner that the rotation of the motor shaft 120 is not transmitted to the second motor belt wheel 620.

The clutch lever 720 includes a head part 721 having an approximate "コ" shape along an outer circumferential surface of the encircling part 712 and a rod part 722 extending from the head part 721. An upper slit 721*a* and a lower slit 721*b* are respectively formed at an upper and a lower top end parts on the head part 721. The head part 721 is connected with the encircling part 712 in such a manner that the upper shaft part 717*a* is contained in the upper slit 721*a* and the lower shaft part 717*b* is contained in the lower slit 721*b*. Thus, the head part 721 can rotate relative to the encircling part 712.

The rod part 722 is composed of an upper member 722*a* and a lower member 722*b* which are opposite at a specified distance, as well as a connecting member 722*c* which connects the upper member 722*a* and the lower member 722*b*. An upper guiding hole 723*a* and a lower guiding hole 723*b* are respectively formed in the upper member 722*a* and the lower member 722*b* in the same position closer to a lever driving apparatus 740 side than a supporting position of the lever supporting part 730. The upper guiding hole 723*a* and the lower guiding hole 723*b* are elongated holes in a left-right direction, and are formed obliquely slightly relative to a long edge direction of the rod part 722 in such a manner that an end part at a clutch body 710 side is slightly closer to a front side than the end part at the lever driving apparatus 740 side.

The lever supporting part 730 has a supporting shaft 731 extending in the up-down direction to support the rod part 722 of the clutch lever 720 in such a manner that the rod part 722 is rotatable by using the supporting shaft 731 as a center.

The lever driving apparatus 740 includes a torque motor 741, a cam 742, a mobile rod 743 and a connecting rod 744. The cam 742 has a disc shape, and rotates around a horizontal axis through a torque of the torque motor 741. A camshaft 742*a* is formed on an upper surface of the cam 742.

An upper guiding shaft 743*a* which protrudes upwards and a lower guiding shaft 743*b* which protrudes downwards are formed on one end part of the mobile rod 743, and a connecting shaft 743*c* which protrudes backwards is formed on the other end part of the mobile rod 743. One end part of the mobile rod 743 passes between the upper member 722*a* and the lower member 722*b* of the clutch lever 720. The upper guiding shaft 743*a* is inserted into the upper guiding hole 723*a*, and the lower guiding shaft 743*b* is inserted into the lower guiding hole 723*b*. The mobile rod 743 is guided by a guiding cylinder 745 arranged on the torque motor 741 in such a manner that the mobile rod 743 can move along a direction perpendicular to the axial direction of the motor shaft 120.

One end part of the connecting rod 744 is rotatably connected with the connecting shaft 743*c* of the mobile rod 743, and the other end part thereof is rotatably connected with the camshaft 742*a* of the cam 742.

The lever supporting part 730 and the lever driving apparatus 740 are fixed to the installing plate 750. The installing plate 750 is fixed to the outer tub 20 through a plurality of screws 760.

Under a condition that the driving form of the driving part 30 is switched from the drum single driving form to the biaxial driving form, the clutch mechanism part 700 is switched from the state shown in FIG. 4 to the state shown in FIG. 5. Namely, as shown in FIG. 5(*a*), the cam 742 is rotated through the torque motor 741 in such a manner that the camshaft 742*a* is closest to the clutch body 710. Thus, the mobile rod 743 moves adjacent to the clutch body 710; and the upper guiding shaft 743*a* and the lower guiding shaft 743*b* of the mobile rod 743 respectively move the upper guiding hole 723*a* and the lower guiding hole 723*b* from the end part at the lever driving apparatus 740 side to the end part at the clutch body 710 side. Since the upper guiding hole 723*a* and the lower guiding hole 723*b* are inclined in such a manner that the end part of the clutch body 710 side is closer to a front side than the end part of the lever driving apparatus 740 side, the clutch lever 720 rotates by using the supporting shaft 731 as the center in such a manner that the head part 721 moves forwards, and the clutch body 710 connected with the head part 721 moves forwards. Thus, the first spline 715 of the clutch part 711 is engaged with the spline 623 of the second motor belt wheel 620.

When the first spline 715 is engaged with the spline 623, since the clutch part 711 and the second motor belt wheel 620 are fixed in the rotating direction, it will be in a state that the rotation of the motor shaft 120 can be transmitted to the second motor belt wheel 620 by the clutch part 711. Under this state, when the driving motor 100 rotates, the rotation is transmitted to the second rotating shaft 300 by the wing speed reducing mechanism part 600, and the rotating body 24 fixed to the second rotating shaft 300 rotates. The rotating body 24 rotates at a rotating speed of the driving motor 100 which is decreased according to the speed reducing ratio of the wing speed reducing mechanism part 600. In addition, the rotation of the driving motor 100 is transmitted to the first rotating shaft 200 by the drum speed reducing mechanism part 500, and the drum 22 fixed to the first rotating shaft 200 rotates. The drum 22 rotates at a rotating speed after the rotating speed of the driving motor 100 is decreased according to the speed reducing ratio of the drum speed reducing mechanism part 500. As described above, since the speed reducing ratio of the wing speed reducing mechanism part 600 is less than the speed reducing ratio of the drum speed reducing mechanism part 500, the rotating body 24 rotates at a rotating speed higher than that of the drum 22 and in the same direction as the drum 22.

Herein, although the clutch part 711 rotates together with the second motor belt wheel 620, since the clutch lever 720 is connected with the encircling part 712 connected with the clutch part 711 in a free rotation state, a torque generated by the rotation is hardly transmitted to the clutch lever 720 even if the clutch part 711 rotates.

On the other hand, under a condition that the driving form of the driving part 30 is switched from the biaxial driving form to the drum single driving form, the clutch mechanism part 700 is switched from the state shown in FIG. 5 to the state shown in FIG. 4. Namely, as shown in FIG. 4(*a*), the cam 742 is rotated through the torque motor 741 in such a manner that the camshaft 742*a* is farthest from the clutch body 710. Thus, the mobile rod 743 moves in a manner of keeping away from the clutch body 710; and the upper guiding shaft 743*a* and the lower guiding shaft 743*b* of the mobile rod 743 respectively move the upper guiding hole 723*a* and the lower guiding hole 723*b* from the end part of the clutch body 710 side to the end part of the lever driving apparatus 740 side. Through an inclined shape of the upper guiding hole 723*a* and the lower guiding hole 723*b*, the clutch lever 720 rotates by using the supporting shaft 731 as the center in such a manner that the head part 721 moves backwards, and the clutch body 710 connected with the head part 721 moves backwards. Thus, the first spline 715 of the clutch part 711 is disengaged from the spline 623 of the second motor belt wheel 620.

When the first spline 715 is disengaged from the spline 623, it will be in a state that the rotation of the motor shaft 120 is not transmitted to the second motor belt wheel 620. Under this state, when the driving motor 100 rotates, the rotation is transmitted to the first rotating shaft 200 by the drum speed reducing mechanism part 500, so that the drum 22 rotates. The drum 22 integrally rotates at a rotating speed of the driving motor 100 which is decreased according to the speed reducing ratio of the drum speed reducing mechanism part 500 in the same direction. In another aspect, even if the driving motor 100 rotates, since the motor shaft 120 idles relative to the second motor belt wheel 620 and the rotation of the driving motor 100 is not transmitted to the second rotating shaft 300, the rotating body 24 does not rotate. Since the second rotating shaft 300 is rotatable relative to the first rotating shaft 200, the rotating body 24 is in a free rotation state.

In addition, the drum washing machine 1 carries out washing operation in various operation modes. The washing operation includes a washing process, an intermediate dewatering process, a rinsing process and a final dewatering process.

The driving form of the driving unit 30 is switched to the biaxial driving form in the washing process and the rinsing process. Under the state that water stored in the outer tub 20 is not reached a specified water level lower than a lower edge of the throwing opening 11, the driving motor 100 alternately conducts right rotation and left rotation. Therefore, the drum 22 and the rotating body 24 alternately conduct right rotation and left rotation under a condition that the rotating speed of the rotating body 24 is higher than the rotating speed of the drum 22. At this moment, the rotating speed of the drum 22 is set so that the centrifugal force acting on the washings in the drum 22 less than gravity thereof.

When the drum 22 and the rotating body 24 rotate, the washings in the drum 22 are lifted up and dropped down by the baffles 23, so that the washings are thrown to the inner circumferential surface of the drum 22. In addition, the washings are in contact with the protruding parts 24*a* of the rotary rotating body 24 at the rear part of the drum 22, and are rubbed or stirred by the protruding parts 24*a*. Therefore, the washings are washed and rinsed.

In this way, during washing and rinsing, since not only the mechanical force generated by the rotation of the drum 22, but also the mechanical force generated by the rotation of the rotating body 24, are applied to the washings, the improvement of the cleaning performance is expectable. Then, in the intermediate dewatering process and the final dewatering process, the driving form of the driving part 30 is switched to the drum single driving form. The driving motor 100 rotates at a high speed in one direction, and the drum 22 rotates at a rotating speed that the centrifugal force acting on the washings in the drum 22 is far more than the gravity thereof. The washings are thrown on the inner circumferential surface of the drum 22 under the effect of the centrifugal force to realize dewatering. At this moment, the rotating body 24 is not rotated by the driving motor 100 and thus becomes a free rotation state.

In this way, since the rotating body 24 is not rotated by the driving motor 100 during dewatering, the washings attached to the drum 22 are not actively stirred by the rotating body 24, thereby dewatering the washing well.

<Effects of Embodiments>

According to the present embodiment, since the drum 22 and the rotating body 24 can generate a rotating speed difference by using a simple structure of the speed reducing mechanisms composed of the transmission belts and the belt wheels, the reliability of the driving part 30 is improved in term of fault and the like compared with a speed reducing mechanism composed of gears. Moreover, the drum 22 and the rotating body 24 can rotate by one driving motor 100, manufacturing the driving part 30 at low cost.

Further, according to the present embodiment, since the rotating body 24 is not rotated by the driving motor 100 when the driving form is switched to the drum single driving form during watering, the washings attached to the inner circumferential surface of the drum 22 are not actively stirred by the rotating body 24 and can be well dewatered.

Further, according to the present embodiment, since the clutch mechanism part 700 adopts a structure which acts between the motor shaft 120 of the driving motor 100 and the second motor belt wheel 620, compared with a situation that the clutch mechanism part 700 adopts a structure which acts between the second belt wheel 610 larger than the second motor belt wheel 620 and the second rotating shaft 300, miniaturization of the structure of the clutch mechanism part 700 can be realized and cost can be inhibited.

Further, according to the present embodiment, in such a structure that the drum 22 and the outer tub 20 are disposed in the housing 10 in a manner of being inclined upwards, since the driving motor 100 is disposed to be closer to the lower side than the first belt wheel 510 and the second belt wheel 610 and the clutch mechanism part 700 is arranged on the driving motor 100 side, the clutch mechanism part 700 is arranged in a space between the outer tub 20 and a back surface of the housing 10 enlarged due to inclination of the drum 22 and the outer tub 20. Thus, since the clutch mechanism part 700 is configured in a manner of not protruding more backwards than the second belt wheel 610, the size of the housing 10 in the front-back direction can be prevented from being increased due to an arrangement corresponding to the clutch mechanism part 700.

Further, according to the present embodiment, the following clutch mechanism part 700 can be realized: under a condition that the driving part 30 adopts a structure of using a speed reducing mechanism composed of transmission belts and belt wheels, the driving form of the driving part 30 can be well switched between the biaxial driving form and the drum single driving form at the driving motor 100 side through the clutch body 710 and the mobile mechanism part M1 that moves the clutch body 710.

Further, according to the present embodiment, since the encircling part 712 is disposed for encircling the clutch part 711 in a free rotation state, and is disposed to be connected with the clutch lever 720, the non-rotatable mobile mechanism part M1 is used for moving the rotatable clutch part 711 along the axial direction of the motor shaft 120.

Further, according to the present embodiment, the motor shaft 120 also acts as a supporting shaft for supporting the second motor belt wheel 620 in a free rotation manner. Therefore, since it is unnecessary to additionally provide the supporting shaft, the cost can be reduced. Moreover, it is unnecessary to conduct shaft alignment between the supporting shaft and the motor shaft 120 under the condition that the supporting shaft is provided, so that the assembling operation of the driving part 30 becomes easy.

Although embodiments of the present disclosure are described above, the present disclosure is not limited to above embodiments. In addition, various changes can also be made to embodiments of the present disclosure in addition to the above change.

<First Change Example>

In above embodiments, for the clutch mechanism part 700, relative to the clutch body 710 being fixed to the driving motor 100, the mobile mechanism part M1 is fixed to the outer tub 20. In contrast, for the clutch mechanism part 800 in the present change example, the clutch body 810 and the mobile mechanism part M2 are fixed to the driving motor 100 together.

Figure 7:
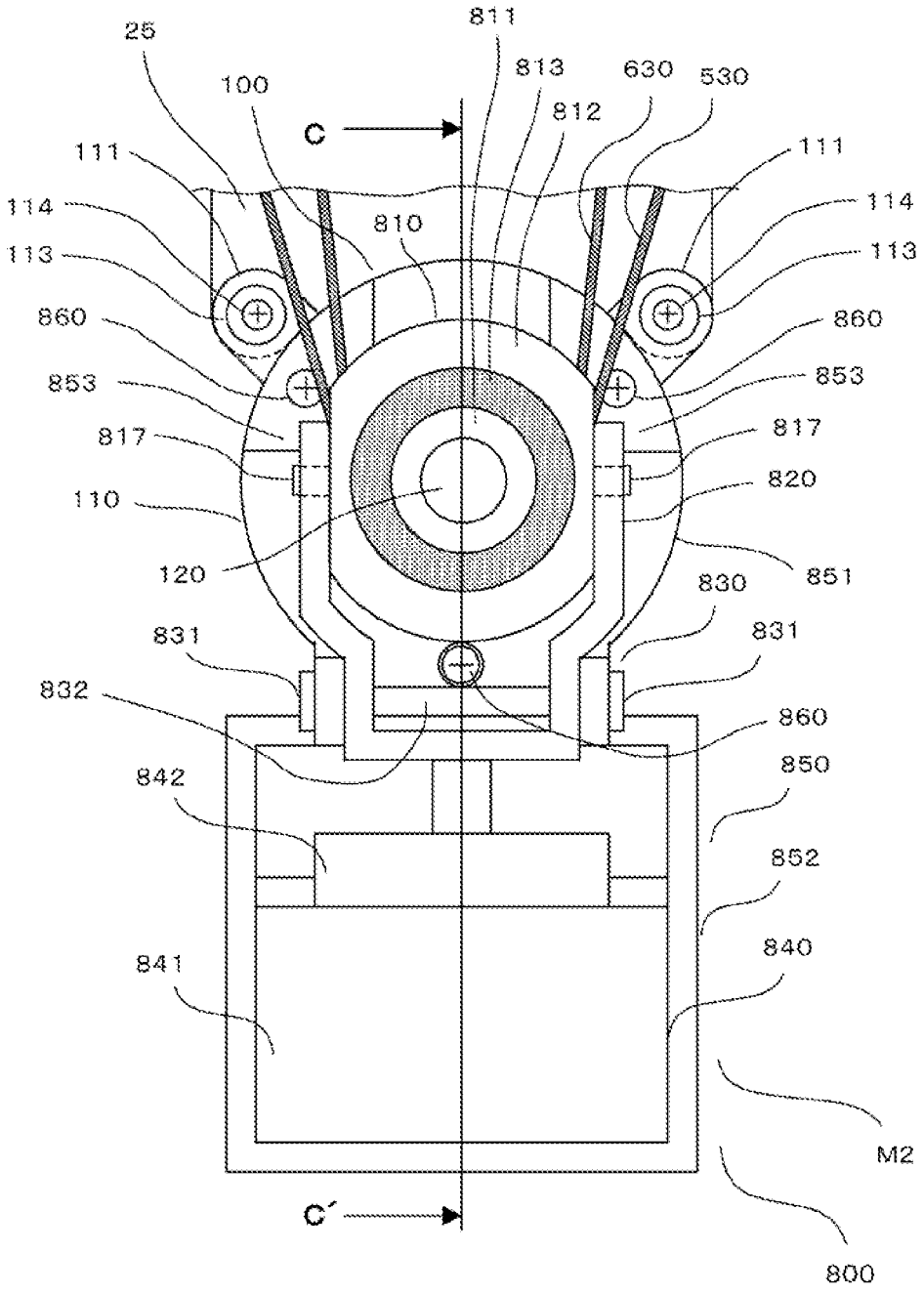
FIG. 7 is a diagram illustrating a structure of a clutch mechanism part according to a first change example.
Figure 8:
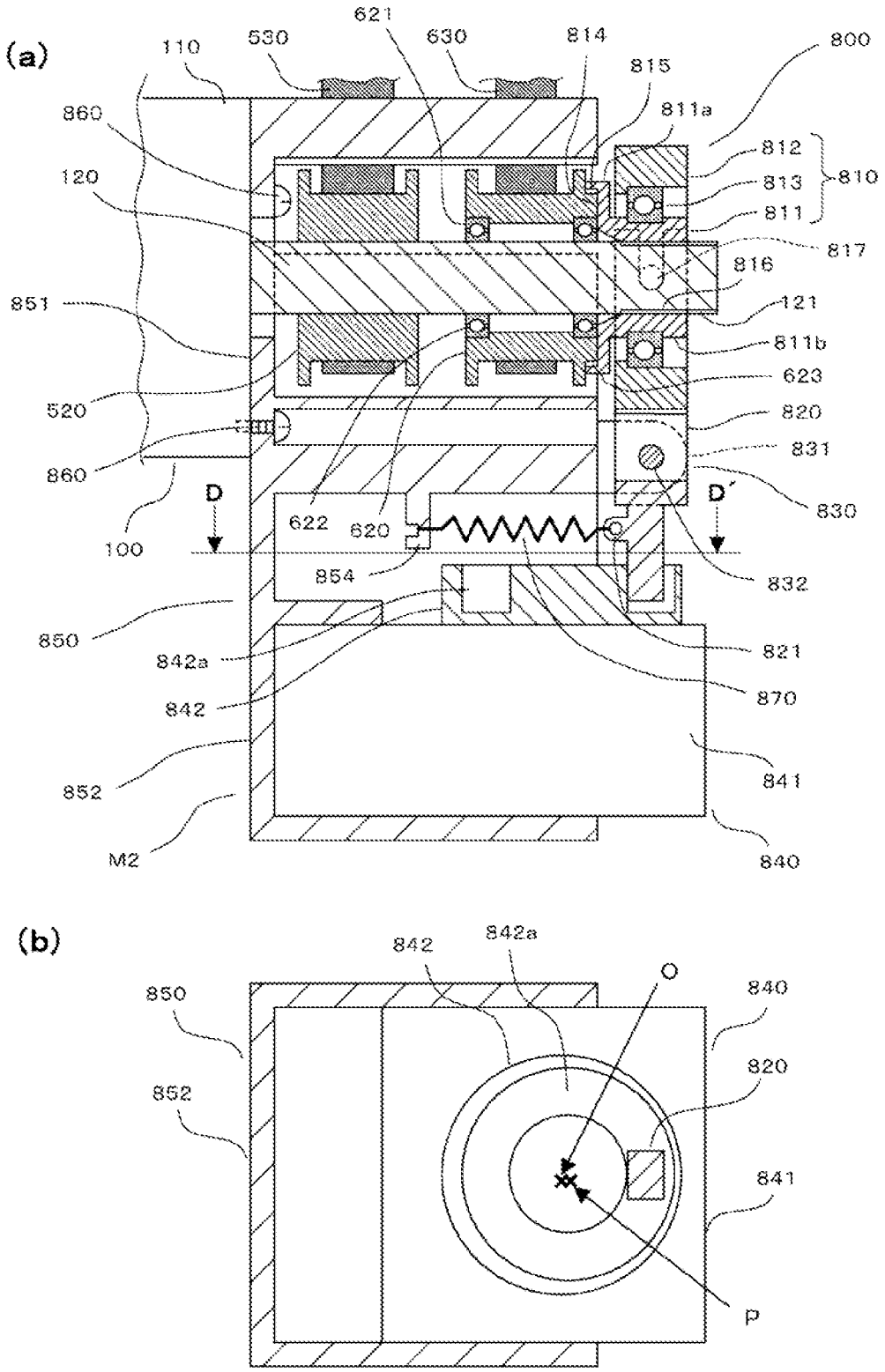
FIG. 8 is a diagram illustrating a structure of a clutch mechanism part according to a first change example.
Figure 9:
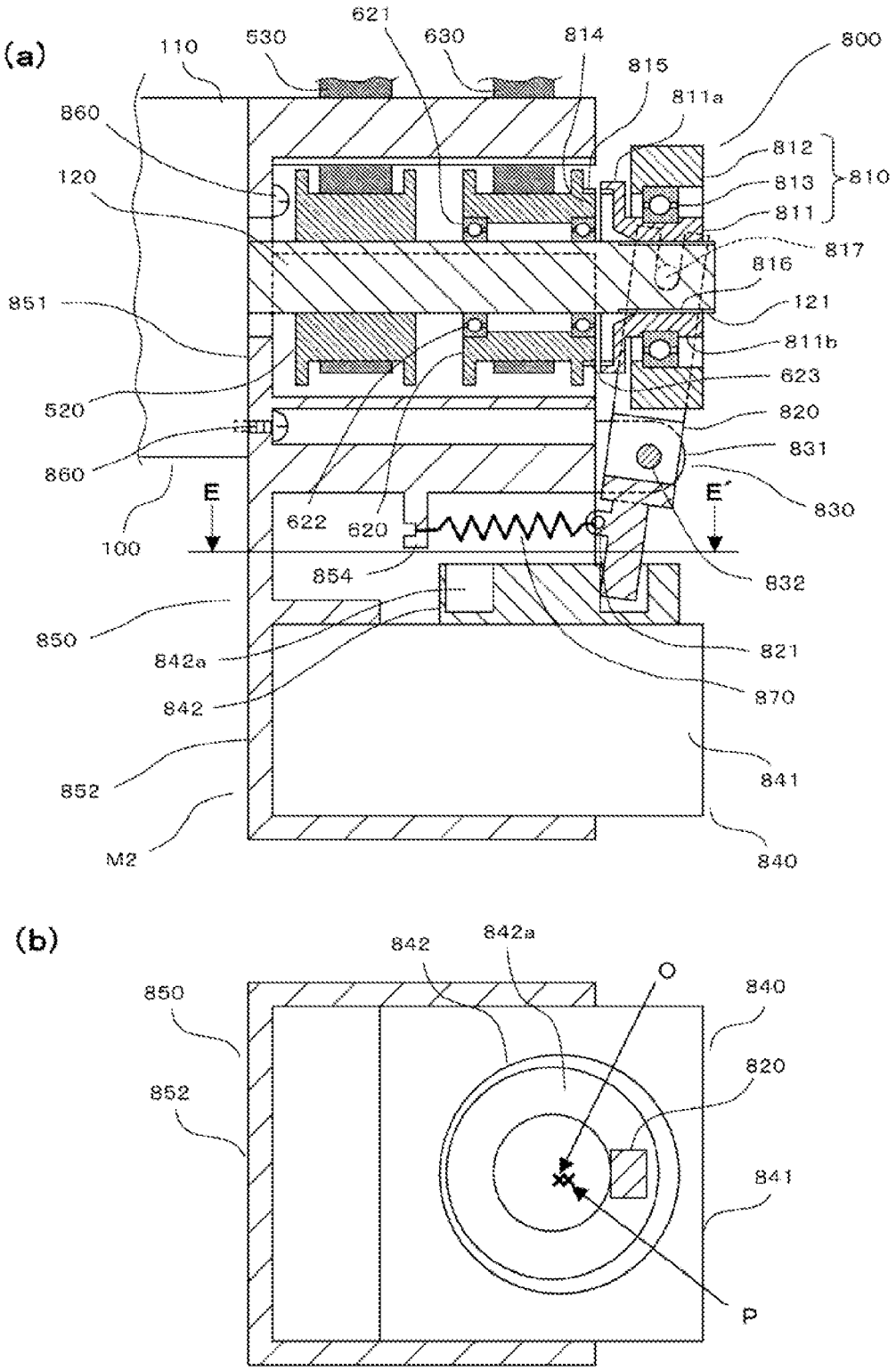
FIG. 9 is a diagram illustrating a structure of a clutch mechanism part according to a first change example.

FIGS. 7 to 9 are diagrams illustrating a structure of the clutch mechanism part 800 according to the first change example 1. FIG. 7 is a diagram illustrating a driving motor 100 provided with a clutch mechanism part 800 observed from a rear side. FIG. 8(*a*) and FIG. 9(*a*) are sectional views of FIG. 7 taken along a line C-C'. FIG. 8(*a*) shows a state of switching a driving form of the driving part 30 to a biaxial driving form. FIG. 9(*a*) shows a state of switching a driving form of the driving part 30 to a drum single driving form. FIG. 8(*b*) is a sectional view of FIG. 8(*a*) taken along a line D-D'. FIG. 9(*b*) is a sectional view of FIG. 9(*a*) taken along a line E-E'.

The clutch mechanism part 800 includes a clutch body 810, a clutch lever 820, a lever supporting part 830, a lever driving apparatus 840 and a housing 850. The clutch lever 820, the lever supporting part 830, the lever driving apparatus 840 and the housing 850 form the mobile mechanism part M2.

The clutch body 810 is disposed at a top end part of the motor shaft 120, and includes a clutch part 811, an encircling part 812 and a rolling bearing 813. The clutch part 811 has a similar structure as the clutch part 711 in above embodiments. A first spline 815 is formed on the inner circumferential surface of the engaging recess part 814 of the front end part 811*a*, and a second spline 816 is formed on the inner circumferential surface of the body part 811*b*.

The encircling part 812 is different from the encircling part 712 in above embodiments. Flat surfaces are formed in a left part and a right part of the encircling part. An axial part 817 is formed on each flat surface. The rolling bearing 813 is sandwiched between the clutch part 811 and the encircling part 812.

The clutch lever 820 has a substantially Y shape. An upper end part of the clutch lever 820 is rotatably connected with the axial part 817 of the encircling part 812.

The lever supporting part 830 includes a left-right arm 831 integrally formed with the housing 850 and a supporting shaft 832 suspended on the left-right arm 831. The lever supporting part 830 supports the clutch lever 820 in such a manner that the clutch lever 820 is rotatable by using the supporting shaft 832 as a center.

The lever driving apparatus 840 includes a torque motor 841 and a cam 842. The cam 842 has a disc shape and rotates around a vertical axis through a torque of the torque motor 841. A cam groove 842*a* on an annular ring is formed in the upper surface of the cam 842. A center P of the cam groove 842*a* is slightly staggered backwards relative to a center O of the cam 842. A lower end part of the clutch lever 820 is inserted into the cam groove 842*a*.

The housing 850 includes a belt wheel containing part 851 and a motor containing part 852, and is fixed to the shell 110 of the driving motor 100 through a screw 860. The first motor belt wheel 520 and the second motor belt wheel 620 are contained in the belt wheel containing part 851. Opening parts 853 are formed in the left side and the right side of the belt wheel containing part 851 for passageway of the first transmission belt 530 and the second transmission belt 630 therethrough. The lever driving apparatus 840 is contained in the motor containing part 852, and is fixed into the motor containing part 852 through fixing apparatuses such as a screw.

A hook part 854 is formed at an upper part of the motor containing part 852. A spring 870 is suspended between the hook part 854 and an installing part 821 of the clutch lever 820. The spring 870 pulls a lower part of the clutch lever 820 towards the front side.

Under a condition that the driving form of the driving part 30 is switched from the drum single driving form to the biaxial driving form, the clutch mechanism part 800 is switched from the state shown in FIG. 9 to the state shown in FIG. 8. Namely, as shown in FIG. 8, the cam 842 is rotated through the torque motor 841 in such a manner that the cam groove 842*a* moves to a backmost side. The lower end part of the clutch lever 820 is guided to the cam groove 842*a*, and moves against a pulling force of the spring 870 backwards. The clutch lever 820 rotates by using the supporting shaft 832 as the center. The upper end part of the clutch lever 820 moves forwards, and the clutch body 810 connected with the upper end part moves forwards. Thus, the first spline 815 of the clutch part 811 is engaged with the spline 623 of the second motor belt wheel 620. The motor shaft 120 is connected with the second motor belt wheel 620 in such a manner that the rotation of the motor shaft 120 is transmitted to the second motor belt wheel 620.

On the other hand, under a condition that the driving form of the driving part 30 is switched from the biaxial driving form to the drum single driving form, the clutch mechanism part 800 is switched from the state shown in FIG. 8 to the state shown in FIG. 9. Namely, as shown in FIG. 9, the cam 842 is rotated through the torque motor 841 in such a manner that the cam groove 842*a* moves to a forefront side. The lower end part of the clutch lever 820 is guided by the cam groove 842*a* to move forwards while being pulled by the spring 870 to one side. The clutch lever 820 rotates by using the supporting shaft 832 as the center. The upper end part of the clutch lever 820 moves backwards, and the clutch body 810 connected with the upper end part moves backwards. Thus, the first spline 815 of the clutch part 811 is disengaged from the spline 623 of the second motor belt wheel 620. The motor shaft 120 is disconnected from the second motor belt wheel 620 in such a manner that the rotation of the motor shaft 120 is not transmitted to the second motor belt wheel 620.

Since the driving motor 100 is fixed to the outer tub 20 via the vibration-proof member 113, the vibration of the outer tub 20 is difficult to be transmitted to the driving motor 100. On the other hand, during washing operation, a movement difference may be generated between the outer tub 20 and the driving motor 100.

In the structure of the present change example, since the mobile mechanism part M2 is fixed to the driving motor 100 side, even if the movement difference is generated between the outer tub 20 and the driving motor 100, it is difficult to apply a load to a connection part between the clutch body 810 and the mobile mechanism part M2. Therefore, reliability of the clutch mechanism part 800 can be enhanced.

<Second Change Example>

Figure 10:
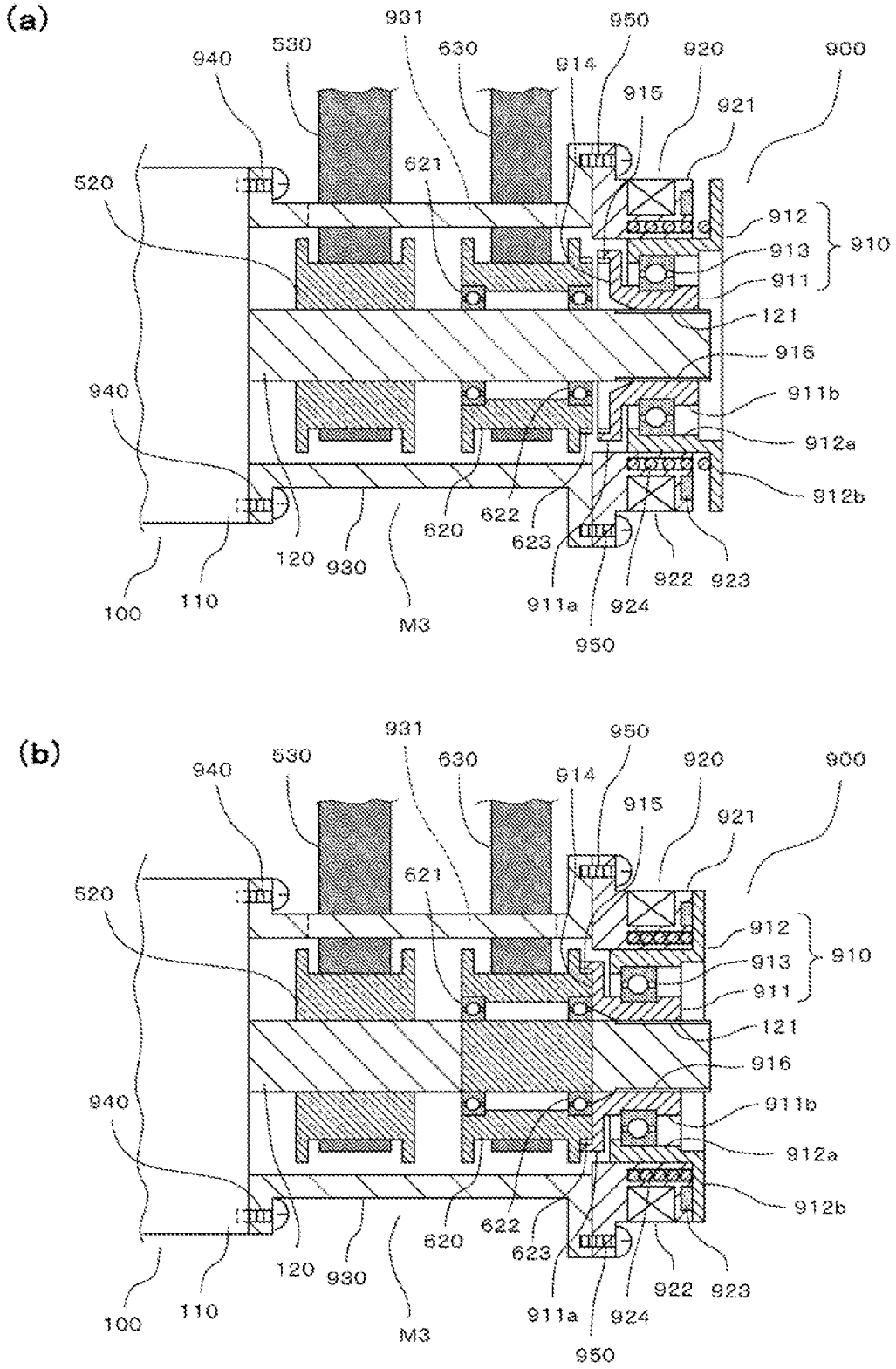
FIG. 10 is a diagram illustrating a structure of a clutch mechanism part according to a second change example.

FIG. 10 is a diagram illustrating a structure of the clutch mechanism part 900 according to the second change example, and is a longitudinal sectional view illustrating a peripheral part of the motor shaft 120. FIG. 10(*a*) shows a state of switching a driving form of the driving part 30 to a drum single driving form. FIG. 10(*b*) shows a state of switching a driving form of the driving part 30 to a biaxial driving form.

In the present change example, like the change example 1, the mobile mechanism part M3 is fixed to the driving motor 100.

The clutch mechanism part 900 includes a clutch body 910, a clutch driving apparatus 920 and an apparatus holding part 930. The clutch driving apparatus 920 and the apparatus holding part 930 form the mobile mechanism part M3.

The clutch body 910 is disposed at a top end part of the motor shaft 120, and includes a clutch part 911, an encircling part 912 and a rolling bearing 913. The clutch part 911 has a similar structure as the clutch part 711 in above embodiments. A first spline 915 is formed on the inner circumferential surface of the engaging recess part 914 of the front end part 911*a*, and a second spline 916 is formed on the inner circumferential surface of the body part 911*b*.

The encircling part 912 includes a substantially cylindrical body part 912*a* which encircles the clutch part 911 and an annular disc-shaped absorbing disc 912*b* formed at a rear side of the body part 912*a*. The encircling part 912 is made of magnetic material such as iron. A rolling bearing 913 is sandwiched between the clutch part 911 and the body part 912*a* of the encircling part 912.

The clutch driving apparatus 920 includes a cylindrical housing 921 which encircles the clutch body 910. An annular coil 922 is installed on the housing 921, and an annular permanent magnet 923 is installed on a rear surface of the housing 921 adjacent to the coil 922. The absorbing disc 912*b* of the encircling part 912 is opposite to the rear surface of the housing 921. A helical spring 924 is contained in the housing 921. The helical spring 924 has a repulsive force that enables the absorbing disc 912*b* to leave far away from the rear surface of the housing 921.

The apparatus holding part 930 has a cylindrical shape, and is fixed to the shell 110 of the driving motor 100 through a plurality of screws 940 in such a manner that the first motor belt wheel 520 and the second motor belt wheel 620 are contained in the apparatus holding part 930. Opening parts 931 are formed in the left side and the right side of the apparatus holding part 930 for the passageway of the first transmission belt 530 and the second transmission belt 630 therethrough. The housing 921 of the clutch driving apparatus 920 is fixed to a rear end part of the apparatus holding part 930 through a plurality of screws 950.

Under a condition that the driving form of the driving part 30 is switched from the drum single driving form to the biaxial driving form, the clutch mechanism part 900 is switched from the state shown in FIG. 10(*a*) to the state shown in FIG. 10(*b*). Namely, the coil 922 of the clutch driving apparatus 920 is energized with a polarity of increasing a suction force of the permanent magnet 923. The absorbing disc 912*b* is attracted by the permanent magnet 923. The clutch body 910 moves against the repulsive force of the helical spring 924 forwards. Thus, the first spline 915 of the clutch part 911 is engaged with the spline 623 of the second motor belt wheel 620. The motor shaft 120 is connected with the second motor belt wheel 620 in such a manner that the rotation of the motor shaft 120 is transmitted to the second motor belt wheel 620.

When the clutch body 910 moves until the absorbing disc 912*b* is absorbed to the permanent magnet 923, the coil 922 is not energized. The magnetic force of the permanent magnet 923 is set in such a manner that the suction force acting on the absorbing disc 912*b* absorbed to the permanent magnet 923 is greater than the repulsive force of the helical spring 924 when the coil 922 is not energized. Therefore, even if the coil 922 is not energized, the clutch body 910 can be kept in a position after movement through the suction force of the permanent magnet 923.

On the other hand, under a condition that the driving form of the driving part 30 is switched from the biaxial driving form to the drum single driving form, the clutch mechanism part 900 is switched from the state shown in FIG. 10(*b*) to the state shown in FIG. 10(*a*). Namely, the coil 922 of the clutch driving apparatus 920 is energized with a polarity of decreasing the suction force of the permanent magnet 923. Since the repulsive force of the helical spring 924 is greater than the suction force of the permanent magnet 923, the absorbing disc 912*b* is pushed backwards through the helical spring 924 and the clutch body 910 moves backwards. Thus, the first spline 915 of the clutch part 911 is disengaged from the spline 623 of the second motor belt wheel 620 and the motor shaft 120 is disconnected from the second motor belt wheel 620 in such a manner that the rotation of the motor shaft 120 is not transmitted to the second motor belt wheel 620.

When the clutch body 910 moves to a position in which the first spline 915 is disengaged from the spline 623, the coil 922 is not energized. Since the suction force acting on the absorbing disc 912*b* from the permanent magnet 923 in this position becomes smaller than the repulsive force of the helical spring 924 when the coil 922 is not energized, even if the coil 922 is not energized, the clutch body 910 can be kept in a position after movement.

In the structure of the present change example, like the first change example, since the mobile mechanism part M3 is fixed to the driving motor 100 side, even if the movement difference is generated between the outer tub 20 and the driving motor 100, it is difficult to apply a load to a connection part between the clutch body 910 and the mobile mechanism part M3. Therefore, the reliability of the clutch mechanism part 900 can be enhanced.

<Other Change Examples>

In above embodiments, in the intermediate dewatering process and the final dewatering process, the driving form of the driving part 30 is switched to the drum single driving form. However, a structure that the driving form is switched to the drum single driving form when the drum 22 rotates in the washing process and the rinsing process can also be adopted. For example, it is particularly expected to switch to the drum single driving form in the washing mode for washing delicate clothes and clothes with dry cleaning identifiers.

Under the state that water is stored in the outer tub 20, when the driving motor 100 rotates in the drum single driving form, the drum 22 rotates and the washings are stirred by the baffles 23.

At this moment, since the washings drop down when being lifted near the right upper part of the drum 22 and by the baffles 23 at the front side of the drum 22, the washings almost rotate twice when the drum 22 completes one rotation. In another aspect, the washings are easy to be pressed by the rotating body 24 at the rear side of the drum 22. As described above, since the rotating body 24 is in a free rotation state, the rotating body 24 also easily rotates together with the washings when the washings are stirred by the baffles 23 to rotate. Therefore, either at the rear side of the drum 22 or at the front side of the drum 22, the washings almost rotate twice when the drum 22 completes one rotation. Therefore, the rotating difference of the washings is not easy to be generated at the front side and the rear side of the drum 22, so it is difficult to generate twisting of the washings caused by the rotating difference.

It should be noted that under the situation that the rotating body 24 cannot freely rotate relative to the drum 22, when the washings are stirred by the baffles 23 and are pushed by the rotating body 24 at the rear side of the drum 22, the washings will not drop near the right upper part of the drum 22 but rotate being attached to the rotating body 24. In this way, since the washings only almost rotate once at the rear side of the drum 22 when the drum 22 completes one rotation, the rotating difference of the washings is easy to be generated at the front side and the rear side of the drum 22, causing twisting of the washings.

In addition, in the drum single driving form unlike the biaxial driving form, since the rotating body 24 is not rotated by the driving motor 100, the washings cannot be rubbed by the rotating body 24.

In this way, in the washing process or the rinsing process, under the situation that the driving motor 100 is operated in the drum single driving form, the washings are difficult to be damaged due to twisting and damaged due to rubbing. Therefore, according to the change example, delicate clothes can be washed or rinsed while the damage to the delicate clothes is inhibited.

In addition, in above embodiments, the clutch part 711 and the second motor belt wheel 620 are fixed in the rotating direction through engagement of the first spline 715 of the clutch part 711 and the spline 623 of the second motor belt wheel 620. However, a structure of engaging the clutch part 711 and the second motor belt wheel 620 is not limited to above embodiments, and can also be other structures. For example, the following structure can be adopted: bulges formed at the clutch part 711 are embedded into recesses or the holes formed in the second motor belt wheel 620.

In addition, in above embodiments, two rolling bearings 621 and 622 are arranged between the second motor belt wheel 620 and the motor shaft 120. In addition, the rolling bearing 713 is arranged between the clutch part 711 and the encircling part 712. However, the rolling bearings 621, 622 and 713 can also be replaced by sliding bearings.

Further, in above embodiments, the drum 22 rotates by using an inclination axis inclined relative to the horizontal direction as the center. However, the drum washing machine 1 may also adopt a structure that the drum 22 rotates by using the horizontal axis as the center.

Further, although the drum washing machine 1 in above embodiments does not have the drying function, the present disclosure can also be used for a drum washing machine with the drying function, i.e., a drum-type drying and washing machine.

Additionally, various changes can be appropriately made to embodiments of the present disclosure within the scope of the technical idea in claims.

What is claimed is:

1. A drum washing machine, comprising:

an outer tub disposed in a housing;

a drum disposed in the outer tub and being rotatable by using a horizontal axis or an inclination axis inclined relative to a horizontal direction as a center;

a rotating body disposed in the drum and provided with a protruding part in contact with washings on a surface; and a driving part configured to rotate the drum and the rotating body, wherein the driving part comprises:

a driving motor;

a first belt wheel fixed to a rotating shaft of the drum;

a second belt wheel fixed to a rotating shaft of the rotating body;

a first motor belt wheel fixed to a motor shaft of the driving motor and connected with the first belt wheel via a first transmission belt;

a second motor belt wheel connected with the second belt wheel via a second transmission belt, the second motor belt wheel rotatably connected to the motor shaft of the driving motor such that the second motor belt wheel is freely rotatable around the motor shaft; and a clutch mechanism part configured for switching a driving form of the driving part between a first driving form, in which the drum and the rotating body rotate at different rotating speeds along with rotation of the driving motor through connection of the motor shaft and the second motor belt wheel in such a manner that the rotation of the motor shaft is capable of being transmitted to the second motor belt wheel, and a second driving form, in which the motor shaft is disconnected from the second motor belt wheel in such a manner that the rotation of the motor shaft is not transmitted to the second motor belt wheel;

wherein the clutch mechanism part is connected to the motor shaft of the driving motor and is operative to engage with the second motor belt wheel in the first driving form and to disengage from the second motor belt wheel in the second driving form.

2. The drum washing machine according to claim 1, wherein the clutch mechanism part comprises:

a clutch part being movable to a first position where the motor shaft is connected with the second motor belt wheel in such a manner that the rotation of the motor shaft is transmitted to the second motor belt wheel and a second position where the motor shaft is disconnected from the second motor belt wheel in such a manner that the rotation of the motor shaft is not transmitted to the second motor belt wheel; and a mobile mechanism part configured to move the clutch part between the first position and the second position.

3. The drum washing machine according to claim 2, wherein the clutch part is movable along an axial direction of the motor shaft relative to the motor shaft and is rotatable together with the motor shaft, and has an engaging part; and the second motor belt wheel has an engaged part engaged with the engaging part when the clutch part moves to the first position through the mobile mechanism part.

4. The drum washing machine according to claim 3, wherein the clutch mechanism part comprises an encircling part that encircles the clutch part in such a manner that the clutch part freely rotates; and the mobile mechanism part is connected with the encircling part.

5. The drum washing machine according to claim 2, wherein the driving motor is fixed to the outer tub via a vibration-proof member; and the mobile mechanism part is fixed to the driving motor.

6. The drum washing machine according to claim 5, wherein the second motor belt wheel is supported by the motor shaft in a free rotation manner.

7. The drum washing machine according to 3, wherein the driving motor is fixed to the outer tub via a vibration-proof member; and the mobile mechanism part is fixed to the driving motor.

8. The drum washing machine according to 4, wherein the driving motor is fixed to the outer tub via a vibration-proof member; and the mobile mechanism part is fixed to the driving motor.

9. The drum washing machine according to claim 2, wherein the second motor belt wheel is supported by the motor shaft in a free rotation manner.

10. The drum washing machine according to claim 3, wherein the second motor belt wheel is supported by the motor shaft in a free rotation manner.

11. The drum washing machine according to claim 4, wherein the second motor belt wheel is supported by the motor shaft in a free rotation manner.

12. The drum washing machine according to claim 5, wherein the second motor belt wheel is supported by the motor shaft in a free rotation manner.

* * * * *